US005974940A

United States Patent [19]

Madni et al.

[11] Patent Number: 5,974,940

[45] Date of Patent: Nov. 2, 1999

[54] RIFLE STABILIZATION SYSTEM FOR ERRATIC HAND AND MOBILE PLATFORM MOTION

[75] Inventors: Asad M. Madni, Los Angeles; Lawrence A. Wan, Malibu; Robert K. Hansen, Burbank; Jim Vuong, Northridge, all of Calif.

[73] Assignee: BEI Sensors & Systems Company, Inc., Sylmar, Calif.

[21] Appl. No.: 08/908,023

[22] Filed: Aug. 20, 1997

[51] Int. Cl.[6] ..... F41G 3/00

[52] U.S. Cl. ..... 89/41.17; 42/75.02; 42/75.04; 42/101

[58] Field of Search ..... 89/41.01, 41.02, 89/41.11, 41.17, 41.19; 42/75.02, 75.04, 101

[56] References Cited

U.S. PATENT DOCUMENTS

| | | | |
|---|---|---|---|
| 2,069,750 | 2/1937 | Coates | 89/41.19 |
| 4,999,939 | 3/1991 | Reese et al. | 42/75.02 |
| 5,392,688 | 2/1995 | Boutet et al. | 89/41.17 |
| 5,686,690 | 11/1997 | Lougheed et al. | 89/41.17 |
| 5,834,677 | 11/1998 | Muller | 89/41.17 |

FOREIGN PATENT DOCUMENTS

| | | | |
|---|---|---|---|
| 2231934 | 12/1974 | France | 43/75.02 |
| 223879 | 4/1925 | United Kingdom | 89/41.19 |

OTHER PUBLICATIONS

Army Research Laboratory, Application of an Inertial Reticle System; Feb. 1996; pp. i–vi, 1–20, and 1–3.

Systron Donner, GyroChip, Feb. 21, 1994, pp. 1–4.

McGraw–Hill Technical Encyclopedia, Fire–control Systems; pp. 125–126.

*Primary Examiner*—Stephen M. Johnson
*Attorney, Agent, or Firm*—Jerry G. Wright; Flehr Hohbach Test Albritton & Herbert LLP

[57] ABSTRACT

An adaptive fuzzy logic based control system for rifle stabilization uses a rifle where the barrel is freely pivoted on the stock which is held by the human being firing the rifle who may be shooting from a moving vehicle or helicopter; alternatively, the firing person may have erratic hand or body motion. During a tracking mode, when the target is being sighted in, undesired motion is sensed by position sensors to effectively lock the rifle barrel in alignment with the stock. During a stabilizing mode just before actuation of the trigger to fire the rifle, the barrel is unlocked, inertial rate sensors make the barrel relatively immune to movement of the stock to facilitate the barrel remaining sighted on the tracked target. The fire control system includes a fuzzy logic controller which by a set of inference rules provides for both alignment of the barrel with the stock during tracking and also for stabilization of the barrel just prior to firing.

15 Claims, 7 Drawing Sheets

| Rule | | Output Signal | Rate of Change | | Actuator |
|---|---|---|---|---|---|
| 1 | If | FL | | Then | L(+) |
| 2 | If | L | (-) | Then | (+) |
| 3 | If | L | (+) | Then | S(+) |
| 4 | If | 0 | | Then | 0 |
| 5 | If | R | (-) | Then | S(-) |
| 6 | If | R | (+) | Then | (-) |
| 7 | If | FR | | Then | L(-) |
L = Left
R = Right
F = Far
L = Large
S = Small
FIG. 9
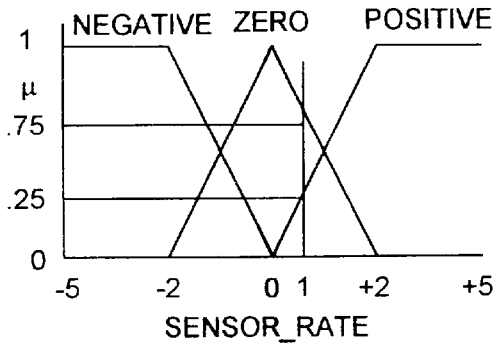
FIG. 10
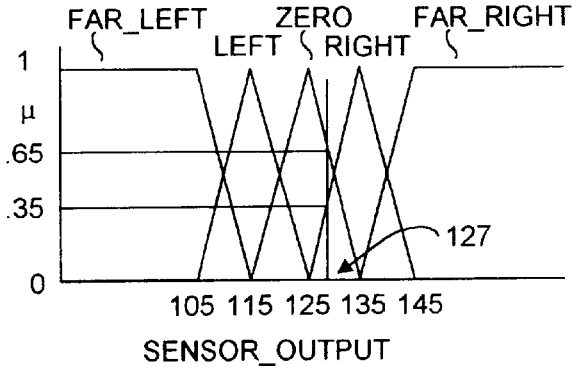
FIG. 11
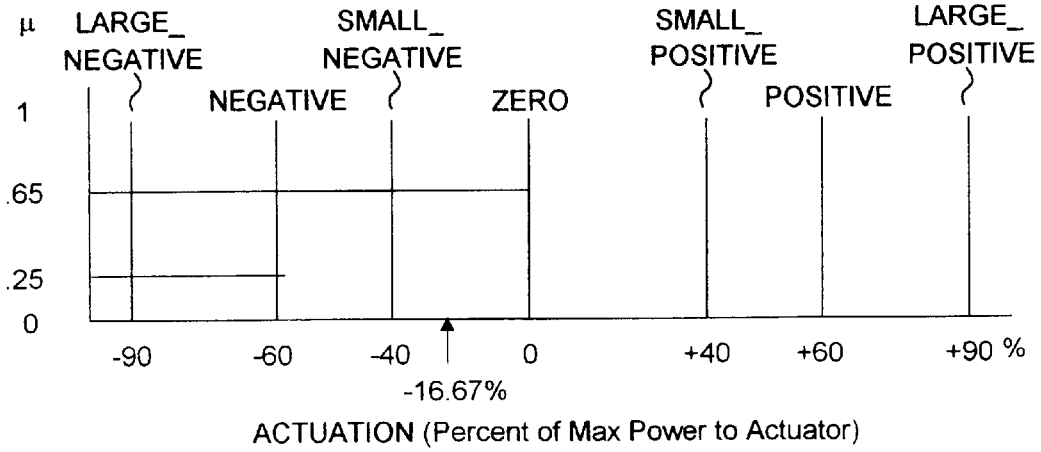
FIG. 12

RIFLE STABILIZATION SYSTEM FOR ERRATIC HAND AND MOBILE PLATFORM MOTION

The present invention is generally directed to a rifle stabilization system for erratic hand and mobile platform motion, and more specifically, to a fire control system based on fuzzy logic.

BACKGROUND OF THE INVENTION

Being able to shoot from an offhand position (that is, where the human being is actually holding a rifle or a gun), especially from direct fire weapons such as sniper rifles and small firearms fired from moving platforms such as helicopters and fast attack vehicles, is always difficult no matter how good the shooter is. Some form of compensation (actually stabilization) is needed in order to significantly improve the accuracy of the firearm under these conditions. This problem may be considered somewhat similar to stabilizing a ship's antenna, except the movement being stabilized comes from a person or human being.

One technique for stabilizing a small arms fire, rather than attempting mechanical stabilization of the weapon or compensating for the moving platform or the actual erratic movement or wobble of the shooter, has been proposed by the United States Army Research Laboratory and is termed an inertial-reticle system (IRS). Here the user employs a video sighting system using a miniature monitor and positions an artificial reticle over the target. Guided by rotation or rate sensors in three axes which track the gun motion, the rifle automatically fires when the actual bore sight of the rifle aligns itself with the target reticle. This system does not stabilize the weapon itself.

OBJECT AND SUMMARY OF INVENTION

It is therefore a general object of the invention to provide a rifle stabilization system for erratic hand and mobile platform motion.

In accordance with the above object, there is provided a fire control system for firing a gun or rifle at a target from a moving platform carrying a human being who is visually tracking (tracking mode) the target by aiming the gun or rifle at the target and actuating the trigger to fire the gun or rifle, or where the firing person may have erratic hand or body motion. The system comprises a gun or rifle having a sight, a stock movable by a human being, and a barrel freely pivotally mounted on the stock at a loading end with its exit end movable in both azimuth and elevation directions, each over predetermined angles by actuator means connected between the stock and the barrel for moving the barrel over the predetermined angles. The barrel has a monostable position substantially aligned with the stock. Means are provided for retaining the barrel in alignment with the stock despite movement of the stock by a human being while in the tracking mode. Servomechanism means control the actuator means at least during a stabilized mode after the target has been tracked and when the trigger is about to be actuated, moving the barrel with reference to said stock to facilitate remaining sighted on the tracked target irrespective of movement of the stock.

BRIEF DESCRIPTION OF THE DRAWINGS

FIG. 9 is a table illustrating fuzzy logic rules.

FIGS. 10, 11 and 12 are graphical membership functions illustrating the implementation of the fuzzy logic of the present invention.

DETAILED DESCRIPTION OF PREFERRED EMBODIMENT

Figure 1:
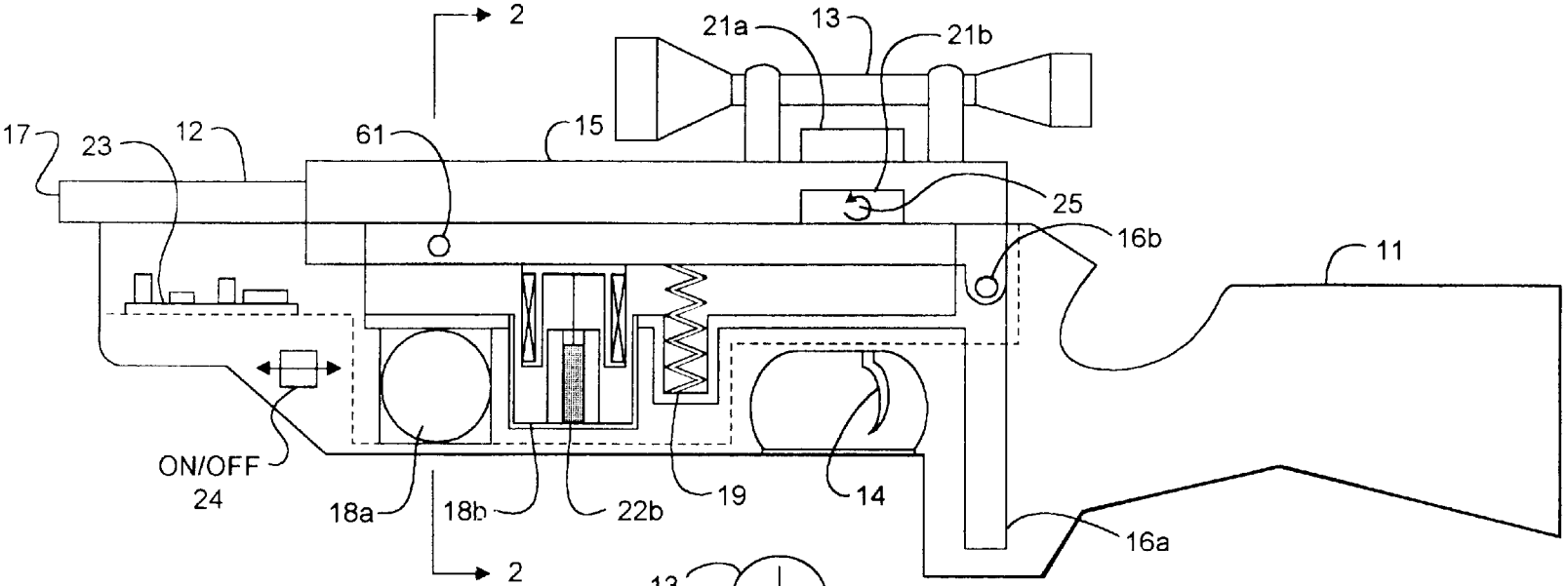
FIG. 1 is a simplified side elevational view of the firearm portion of the fire control system of the present invention.
Figure 2:
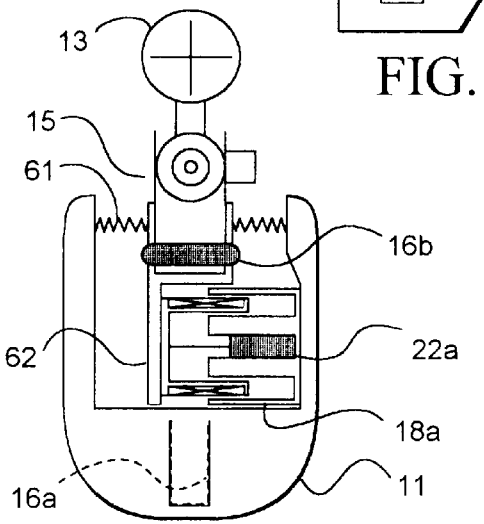
FIG. 2 is a front elevational view taken along the line 2—2 of FIG. 1.

FIGS. 1 and 2 show respectively a side view and a front view of a stabilized rifle constructed and controlled in accordance with the fire control system of the present invention. Referring to both figures, the rifle has a stock 11 which is held and moveable by a human being who fires the rifle, a barrel 12, a gun sight or scope 13 mounted and moveable with barrel 12 (necessarily so since the sight 13 must be lined up with the bore sight of the barrel 12), and a trigger unit 14.

Figure 3:
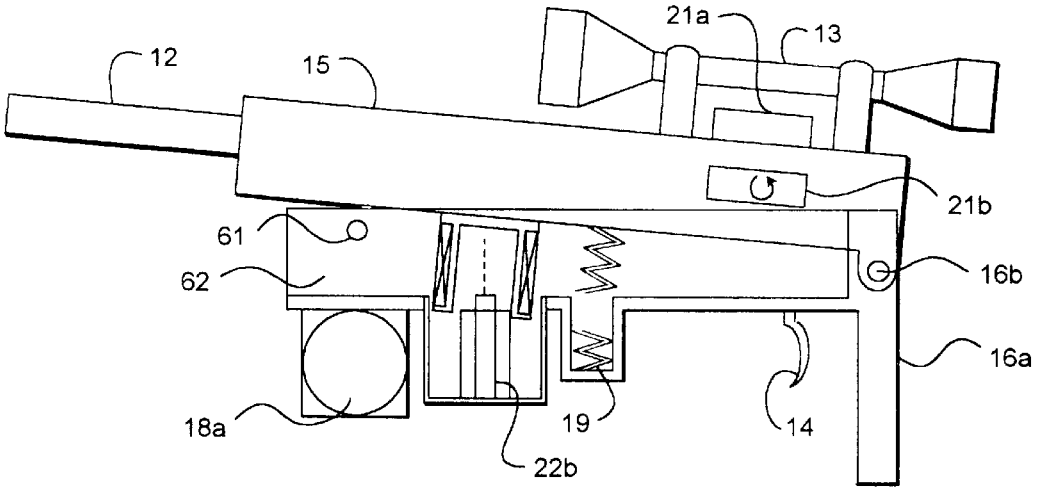
FIG. 3 is a side elevation view similar to FIG. 1 showing a barrel tilted vertically.

Referring now also to FIG. 3, barreled action 15 is illustrated which is in the form of a U-shaped channel which carries within it barrel 12 and the remainder of the loading and firing apparatus and, of course, it carries the scope 13 as well as motion sensors 21*a* and 21*b* which will be described below. This entire barreled action 15 is mounted for vertical movement within the rigid vertical channel shaped support 62 which actually is a part of the horizontal pivot assembly. Support 62 has at its end a horizontal pivot assembly 16*a* which pivots in the stock 11 by a cylindrical vertically mounted bearing. Thus the support 62 is rigid vertically and forms the total support for the entire barreled action 15. The horizontal pivot assembly 16*a* allows a horizontal movement of support 62 over a small angle. The support does not allow the barreled action 15 to move horizontally within it but allows free movement of the barreled action vertically on a horizontally mounted bearing 16*b* which is mounted on the same axis (but perpendicular to that axis) as the horizontal pivot assembly 16*a*.

Thus in partial summary the pivot 16*b* allows the barreled action 15 including barrel 12 to move over a predetermined angle, typically ±1.5° in the elevation direction, as illustrated in FIG. 3. The showing in FIG. 3 is greatly exaggerated. The same is true of the horizontal motion of the support 62 and its pivot 16*a*.

Referring briefly to FIG. 2, the springs 61 mounted between the vertical channel support 62 and to the stock 11 nominally center the barrel horizontally in a monostable position substantially aligned with the stock absent any external forces. Similarly the spring 19 does the same thing with respect to barreled action 15 in the vertical direction.

Figure 6:
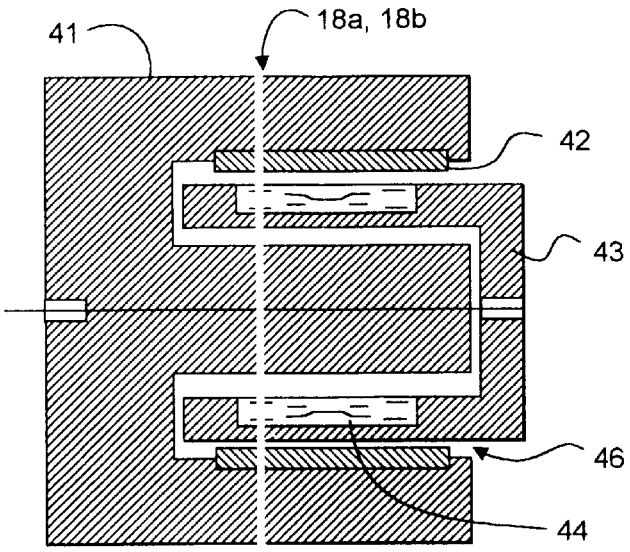
FIG. 6 is a cross sectional view of an actuator used in the present invention.

As described above, the barreled action 15 and the barrel 12 are freely movable (except for the slight resistance of the springs) over azimuth and elevation directions of predetermined angles. To control such movement there are provided horizontal and vertical actuators (or rather azimuth and elevation actuators) 18*a* and 18*b*. Actuator 18*a* is best shown in FIG. 2 and has a portion attached to stock 11 with a movable portion attached to vertical channel support 62. Of course, the vertical channel support is actually part of the horizontal pivot assembly. Similarly a vertical actuator 18*b* (best shown in FIG. 1) has a fixed portion connected to stock 11 and a movable portion to barreled action 15 as shown in FIG. 3. These actuators are actually voice coil type actuators as fully illustrated in FIG. 6 which is a cross-sectional view.

Each includes the soft iron base 41, a permanent magnet 42, a tubular coil 44 in a movable holder, and a fixed working air-gap 46. In operation the permanent magnet field and coil winding produce a force proportional to the current applied to the coil. This actuator is commercially available from Kimco Magnetics Division of the assignee of the present application located in San Marcos, Calif.

Figure 5:
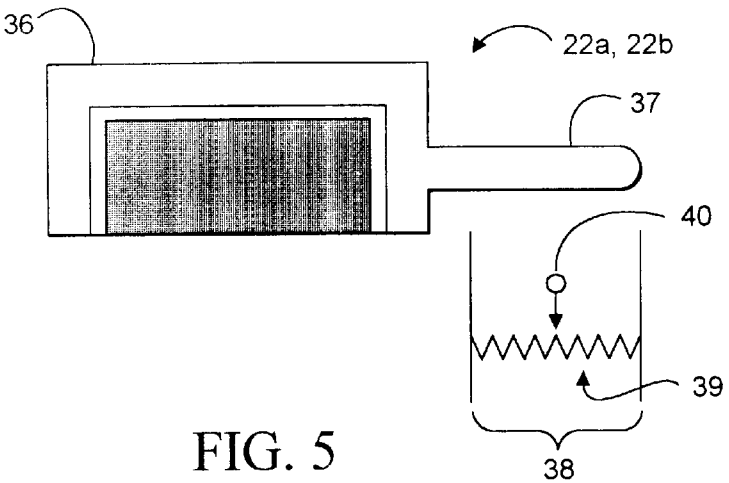
FIG. 5 is a simplified plan view and a simplified circuit showing a position sensor used in the present invention.

To determine any non-alignment of the barreled action 15 in barrel 17 with the stock whether due to movement of the platform on which the person firing the rifle is standing or erratic motion of the firing person himself there are provided a pair of position sensors 22*a* and 22*b* which are actually mounted within the respective actuators 18*a* and 18*b*. They are, in effect, a potentiometer system which senses any deviation from a nominal center point. In other words, output signals are provided related to movement of the barrel in azimuth and elevation directions with respect to stock. The two portions of each position sensor are respectively mounted to the fixed and movable portions of their associated position sensor as illustrated in FIGS. 1 and 2. These position sensors 22*a* and 22*b* are commercially available, as fully illustrated in FIG. 5, and are termed linear position sensors. They include a body 36 and an actuating shaft 37 having a range of mechanical travel 38. Inside the sensor body 36 is a potentiometer unit 39 which provides the position sensing output signal at 40. The shaft 37 is spring loaded to automatically return to an extended position. This unit is available as Model No. 9600 Series from the Duncan Electronics Division, a subsidiary of the assignee of the present invention, and located in Tustin, Calif.

To detect both azimuth and elevation motions of barreled action 15 and barrel 17, irrespective of movement of stock 11 or any other independent force, there are provided motion or rate sensors 21*a* and 21*b* mounted on barreled action 15. As will be discussed below they are actuated by a first detent in trigger 14 which occurs just before the trigger is about to be actuated to fire the rifle; the time lapse may be a split second or several seconds depending on how the target is being tracked by the human being firing the rifle. This period of time between actuation of rate sensors 21*a* and 21*b* and the firing is termed the stabilized mode.

Before that time while the operator of the rifle is tracking the target, is termed the tracking mode. The tracking mode is initiated, as will be discussed below, by turning the on-off switch 24 (FIG. 1) mounted on the stock 11 to the on position to actuate the electronics 23. These electronics as will be discussed below are part of the servomechanism system and fuzzy logic controller of the present invention. Each rate sensor 21*a* and 21*b* generates in response to movement in the horizontal or vertical direction respectively, a signal only with rotation around the axis of symmetry designated 25 (see rate sensor 21*b*). Therefore as illustrated in FIG. 1 the rate sensor 21*a* would have its axis mounted in a different direction than rate sensor 21*b*. Thus the rate sensor senses the movement only in the plane that its output signal will control. When the rate sensor senses rotational movement in that plane, it produces an output signal proportional to that rate of movement to the electronic controller or servomechanism 23. The electronics then processes the signal voltage to apply a countering voltage to the respective linear actuators 18*a* and 18*b*. This closed loop will be discussed in detail below and how the fuzzy logic control system works to maintain the rate sensor output as zero. This eliminates movement of stock 11 from being transmitted to barreled action 15 except for that which is transmitted through the springs which is a very smooth movement by comparison.

Figure 4:
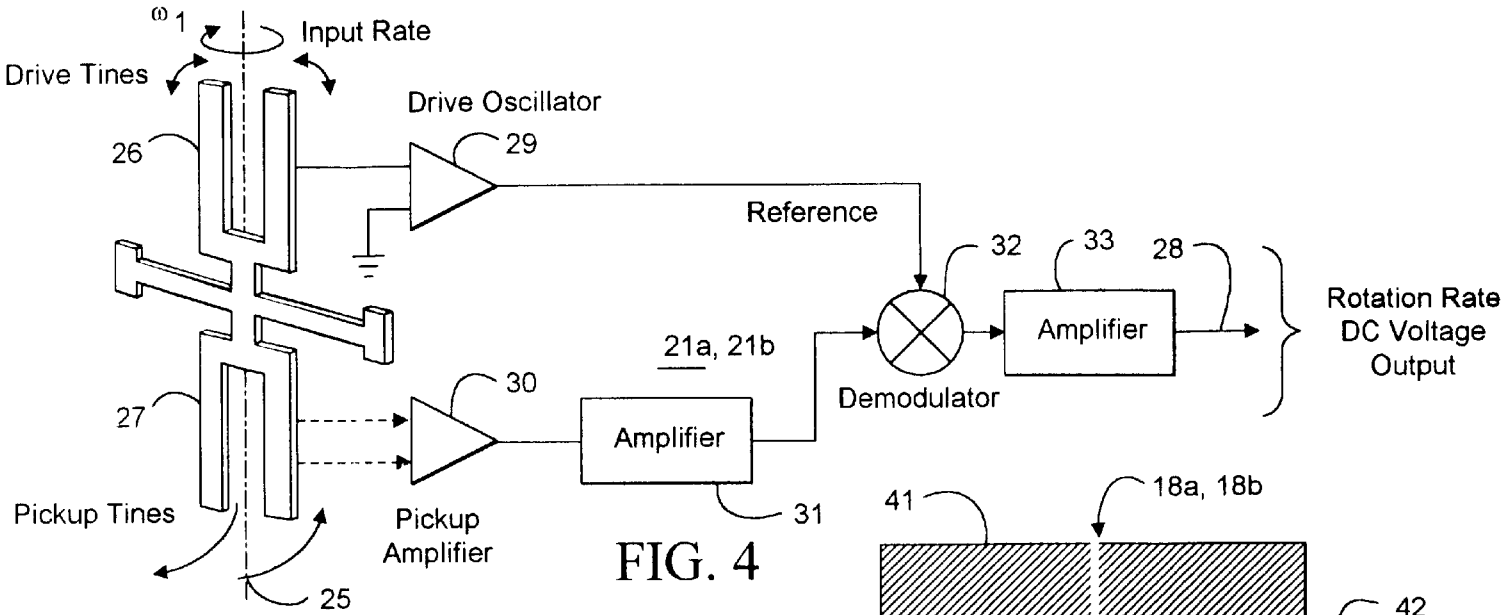
FIG. 4 is a rate sensor utilized in the present invention simplified and shown partially in block diagram.

FIG. 4 illustrates the details of the miniaturized solid state rate sensors 21*a* and 21*b* which use a pair of quartz vibrating tuning forks, with the drive tines 26 and the pickup tines 27, to sense angular velocity or rate. By using the Coriolis effect, a rotational motion about the sensors longitudinal axis 25 produces a DC voltage as shown at output 28 proportional to the rotation rate of the sensors. The microminiature double ended quartz tuning forks 26, 27, and supporting structure, are fabricated chemically from a single wafer of monocrystalline isolectric quartz. Associated processing circuitry includes a drive oscillator 29, a pickup amplifier 30 and supplementary amplifier 31 which are all fed to a demodulator 32 and amplified at 33. The system illustrated in FIG. 3 is commercially available under the trademark GYROCHIP sold by the BEI Systron Donner Inertial Division. The concept of the sensors is disclosed in U.S. Pat. No. 4,524,619 issued Jun. 25, 1985. Since the quartz rate sensor (QRS) will generate a signal only with rotation about the axis of symmetry 25 of the fork, this means that the QRS can also truly sense a zero rate input as well as provide a signal for a specific plane of movement.

In conjunction with the servomechanism system and fuzzy logic controller to be described below, in operation during a tracking mode where the human being or person who is carrying the stock is visually tracking the target by aiming the gun or rifle at the target, the two position sensors 22*a* and 22*b* cause the barrel to be virtually motionless within the stock while the stock is moved around to track the target. In other words, the output signal of these position sensors after processing by the fuzzy logic controller to be described below, causes the actuators 18*a*, 18*b* to maintain or lock the barrel in alignment with the stock (with respect to azimuth and elevation). From a common sense point of view this allows the person firing the rifle to effectively use the sight 13 to acquire or track the target (sight the target). Then just prior to full actuation of the trigger (when erratic or a random motion may be present) the system enters a stabilized mode where the rate sensors 22*a* and 22*b* drive the actuators to actually move the barrel with reference to the stock (making the barrel immune to movement of the stock) to facilitate remaining sighted on the tracked target irrespective of movement of the stock.

Figure 7:
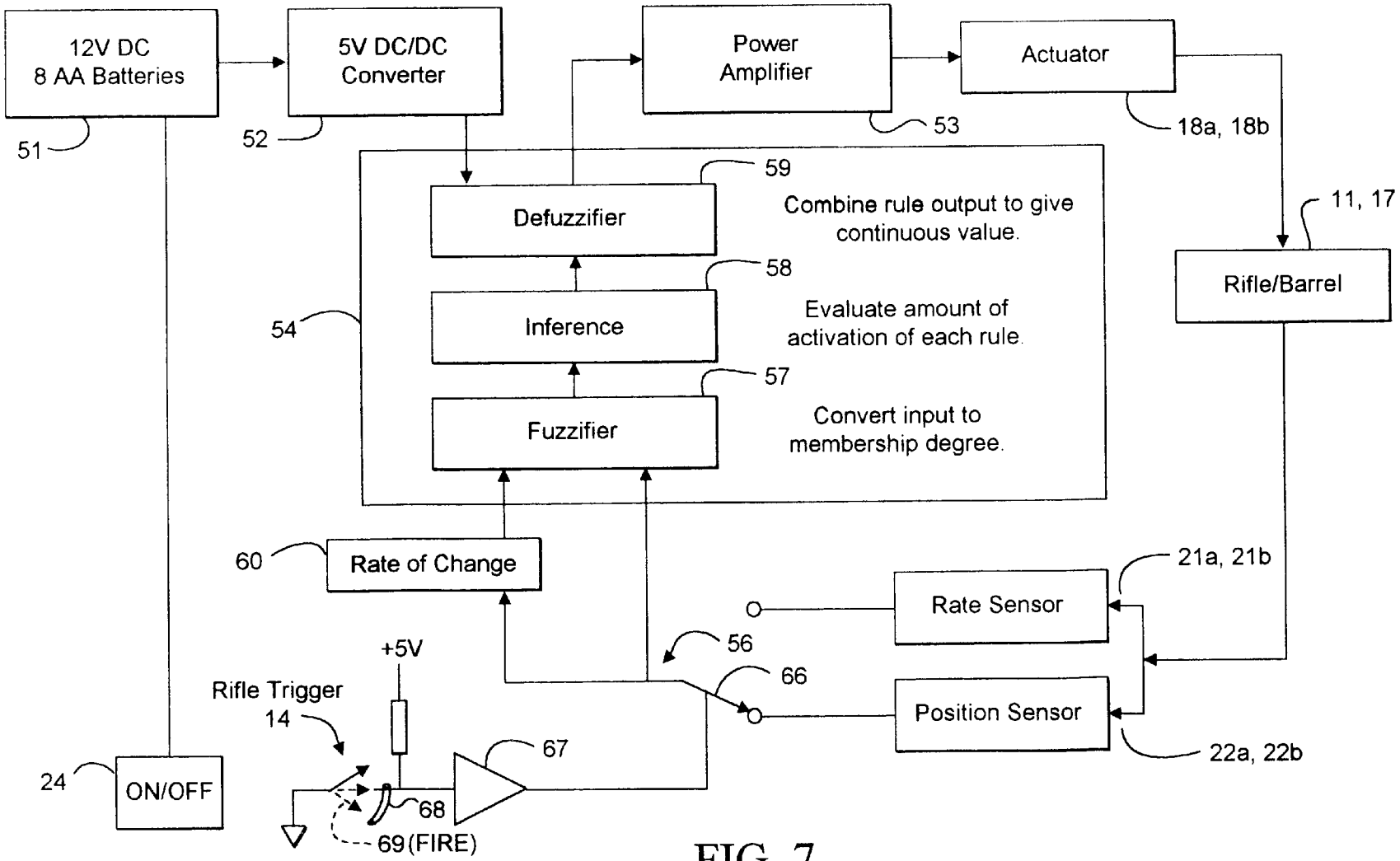
FIG. 7 is an overall block diagram of the fire control system of the present invention.

All of the foregoing servomechanism actions are accomplished by the logic controller contained at 23 within stock 11. This also includes a battery power supply. FIG. 7 shows the circuit and will be discussed below.

FIG. 7 is a block diagram of the servomechanism or fire control system for the rifle stock and barrel, 11 and 17. A separate logic system would be used for azimuth and elevation directions of the system. In other words, there are two completely independent control systems for the two axes of control of barreled action 15, one rotated 90 degrees from the other. What is shown for simplicity is a single diagram of one of the axes describing the electronics of the system.

Contained in the barrel's stock 11 at 23 are batteries 51 with a converter 52 along with the power amplifier 53 which drives the actuators 18*a* and 18*b* and also the rate and position sensors 21*a*, 21*b* and 22*a* and 22*b*. The fuzzy logic controller unit is shown at 54 which detects the outputs on line 56 of the rate and position sensors 21*a*, 21*b* and 22*a*, 22*b* in the appropriate time sequence (first during the tracking mode for the position sensors and then during the stabilized mode for the rate sensors). Then by means of the three well known functional steps of a fuzzy logic controller, the output signals from the sensors are converted to drive signals for the actuators 18*a* and 18*b*. These three fundamental units are the fuzzifier 57 which converts the input signals to membership degrees, inference unit 58 which evaluates the amount of activation of each rule and the defuzzifier unit 59 which combines the rule output to give a continuous value. These are all well known functions and are accomplished in commercially available fuzzy logic software.

In addition to the direct output from rate and position sensors on line 56, the rate of change of these signals is computed in a sensor rate of change unit 60 which measures the sensor output in equal time intervals (approximately 800 microseconds) and computes the difference between the two subsequent readings.

The change from a tracking mode where the position sensor is connected to the fuzzy controller 54 via line 56 and the stabilized mode where the rate sensor is connected is accomplished by a switch 66 which is driven through an amplifier 67 by the rifle trigger 14 being moved to a first detent position at 68. And then as shown by the dashed line 69, the final position is the firing position. Of course, electrical contact is still made with amplifier 67. To initiate the tracking mode and activate the electronics on-off switch 24 (which is on the stock of the rifle) is turned on.

Figure 8:
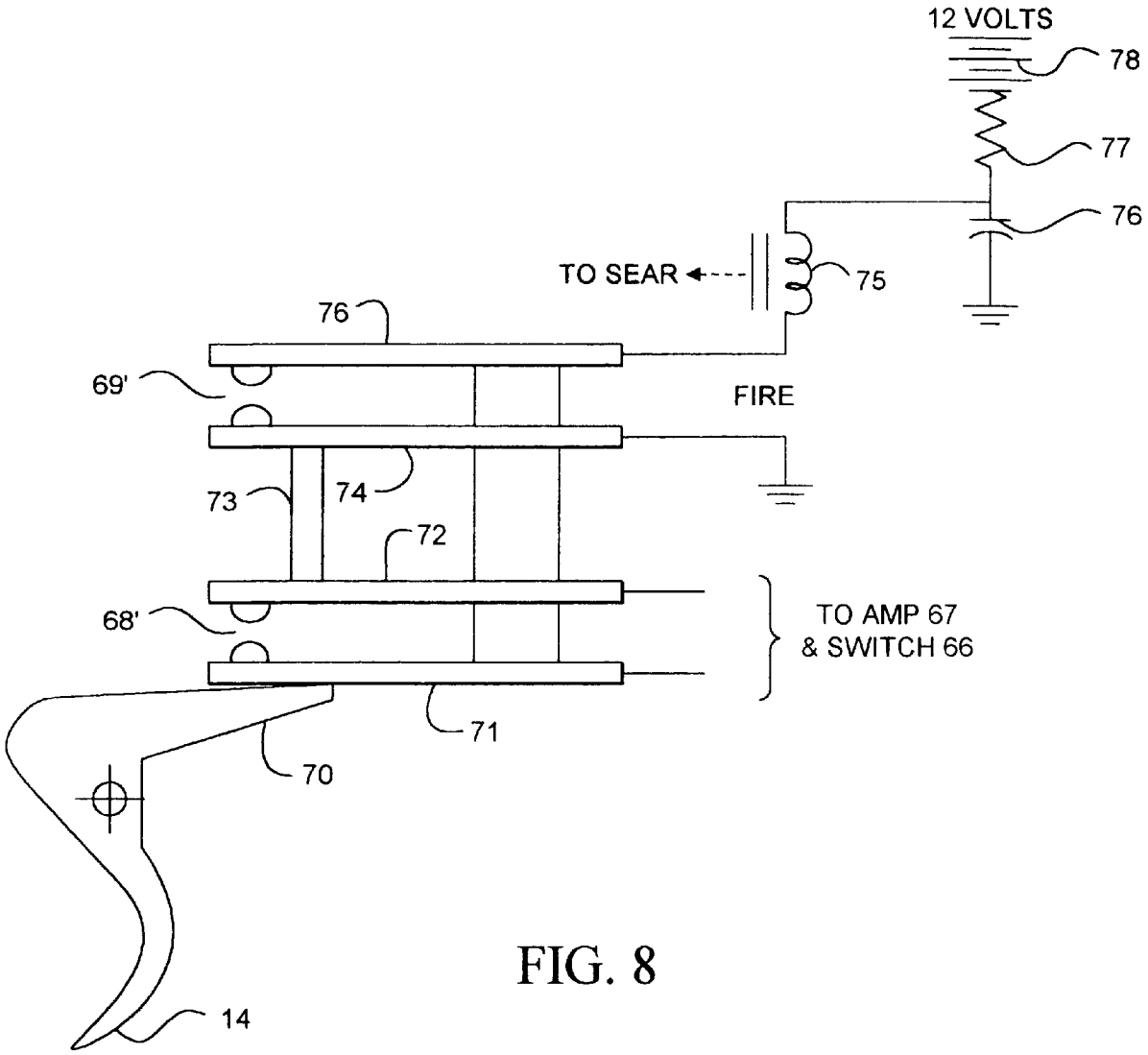
FIG. 8 is a detailed side view of trigger mechanism shown schematically in FIG. 7.

FIG. 8 more aptly illustrates the foregoing action of the trigger 14 where the trigger includes a lever portion 70 which normally abuts in its rest position as illustrated in FIG. 8 against a leaf spring contact 71. However when rotated to its first detent position, where the servomechanism system is placed in the stabilizing mode, lever 70 moves lower spring contact 71 against upper contact 72 to close a pair of electrical contacts designated as 68'; this is, in essence, the contact 68 illustrated in FIG. 7. Amplifier 67 is actuated causing switch 66 to switch the position sensor to the rate sensor as illustrated in FIG. 7. Continued movement of the trigger 14 to a final firing position moves both the switch combinations 71 and 72 and the post 73 past the first detent position to cause a second set of contacts 74, 76 to close to fire the rifle or gun. Thus when the contact 69' closes., this is equivalent to the firing position as shown in FIG. 7 and is so labeled. Coupling post 73 effectively provides for continued closure of the contact 68' during actuation of the contact 69' since the trigger and its lever arm 70 must actuate the switch 69' by pushing both of the contacts 71, 72 past the first detent position to close switch 69'. In other words the function provided by the contact 68' in FIG. 7 continuously activates amplifier 67. What actually happens electrically is that a solenoid 75 is grounded which actuates the sear of the firing mechanism (since this is so well known this is not shown). Solenoid 75 is powered by a charged up capacitor 76 which is charged through resistor 77 by a 12-volt battery 78 which is continuously connected to the capacitor. Closure of contact 69' connects solenoid 75 to ground, thus producing a one shot firing action. The capacitor 76 requires three to four seconds to recharge or reset. Thus the circuit is an effective resetable one shot logic circuit. This conforms to the physical operation of the rifle and its trigger since a person firing the rifle would continue to squeeze the trigger. The amount of current flowing in the capacitor 76 is limited by the resistor 77 so as not to discharge the battery 78

Both trigger 14 and the electrical trigger switching means constituting the contacts 71, 72, 74, 76 are all fixed or attached to stock 11. Thus the barrel 15 is still freely movable being attached to the trigger mechanism by only a pair of thin wires which connect to the solenoid 75 which, of course, is carried by the movable barrel and the necessary components of the sear mechanism to cause firing. Since the trigger is physically isolated from movement of barrel 15 any unwanted restrictive mechanical feedback by the firing person during actuation of the trigger is prevented.

Thus to partially summarize, the fuzzy controller for the rifle stabilization system receives error information (rifle motion) from the rate and position sensors in each of two axes (azimuth and elevation) and using the principles of fuzzy logic drives the actuators in azimuth and elevation directions to eliminate motion induced error. In a tracking mode, where the barrel since it is bearing mounted it is necessarily fairly freely moveable, to insure accurate tracking the barrel is maintained in its monostable aligned position by the actuators. And the same fuzzy logic system upon the activation of the trigger to a first detent activates the rate sensor output to be used for controlling the actuators which move the barrel (within the ±1.5° limitation) to compensate for motion induced error either by the wobble of the gunner or the motion of the platform. The shift between the tracking and firing modes is ideally done almost instantaneously and thus electronically. Use of the same fuzzy logic controller makes this possible. However a simple solution if feasible, might be a mechanical lock that would be withdrawn by moving the trigger to the first detent.

Moreover the use of a fuzzy logic controller is superior to other control systems such as a proportional derivative (PID system) where because the stabilization system must center on a dead zone, a PID system is subject to vibration. It is also believed such a PID system could not easily shift between the tracking and firing modes. But the fuzzy logic aptly lends itself to such common use.

The fuzzy logic controller 54 illustrated in FIG. 7, is governed by the seven rules of FIG. 9. The "output signal" is, of course, a signal from either the rate or position sensors 21*a*, 21*b* and 22*a*, 22*b*. Depending on the magnitude of the signal, it could indicate the barrel has moved or should be moved to the left, right, or far left or far right, or centered at zero aligned with the stock. The other input is "Rate of Change" (see unit 60) which is negative, positive or zero. In the case of the position sensors 22*a*, 22*b*, the intuitive result of these two inputs is an output to the azimuth or elevation actuators 18*a*, 18*b*, of large or small positive or negative movements, or normal positive or negative movements or zero. All of the foregoing in the table of FIG. 9 is illustrated by the input membership functions of FIG. 10 for sensor rate of change and FIG. 11 for sensor output signal. The actuator membership function of FIG. 12 is the percent of maximum power to the actuators. Thus the labels on FIGS. 10, 11 and 12 directly relate to the columns of FIG. 9. For input membership functions as illustrated in FIGS. 10 and 11, a triangular type of membership function is utilized. This is in the fuzzifier step 57 in FIG. 7.

Then as shown in FIG. 12, are the inference and defuzzification processes (see steps 58 and 59 in FIG. 7), Since the rifle stabilization is an engineering application of fuzzy logic, a criterion of computation simplicity led to the choice of the singleton technique as a preferred defuzzifier as shown in FIG. 12. Each fuzzy output is multiplied by its corresponding singleton position. The sum of these products is divided by the sum if all fuzzy outputs to attain the X or Y axis position of the center of gravity result as defined in the following equation:

$$\text{Crisp Output} = \frac{\sum_i (\text{fuzzy output}_i) \times (\text{Maxima of output membership function}_i)}{\sum_i (\text{Fuzzy output}_i)}$$

The following example shows how to derive a crisp value. As an example, if the "crisp" value of the SENSOR OUTPUT (see FIG. 11) is 2.54 Vdc (which is equal to a count of 127 when digitized by an 8-bit analog-to-digital converter with a 5 Vdc as reference), then ZERO has a degree of membership of 0.65 and RIGHT has a degree of membership of 0.35. When the "crisp" value of SENSOR RATE is equal to +1, then ZERO has a degree of membership of 0.75 and POSITIVE has a degree of membership of 0.25. In this case rules 4 and 6 are both active. In the case of rule 4, when SENSOR OUTPUT is ZERO (0.65) then ACTUATION is in ZERO condition. In rule 6, when SENSOR OUTPUT is RIGHT (0.35) and SENSOR RATE is POSITIVE (0.25), the minimum value, 0.25 is selected for the ACTUATION is NEGATIVE condition.

For the example defined above, the output of the power amplifier to drive the actuator (as a percent of maximum power to the actuator) i.e., ACTUATION is computed to be:

$$\text{ACTUATION} = \frac{.65 \times (0) + .25 \times (-60)}{.65 + .25} = -16.67\% \text{ of maximum output}$$

This is shown on the diagram of FIG. 12.

Figure 13:
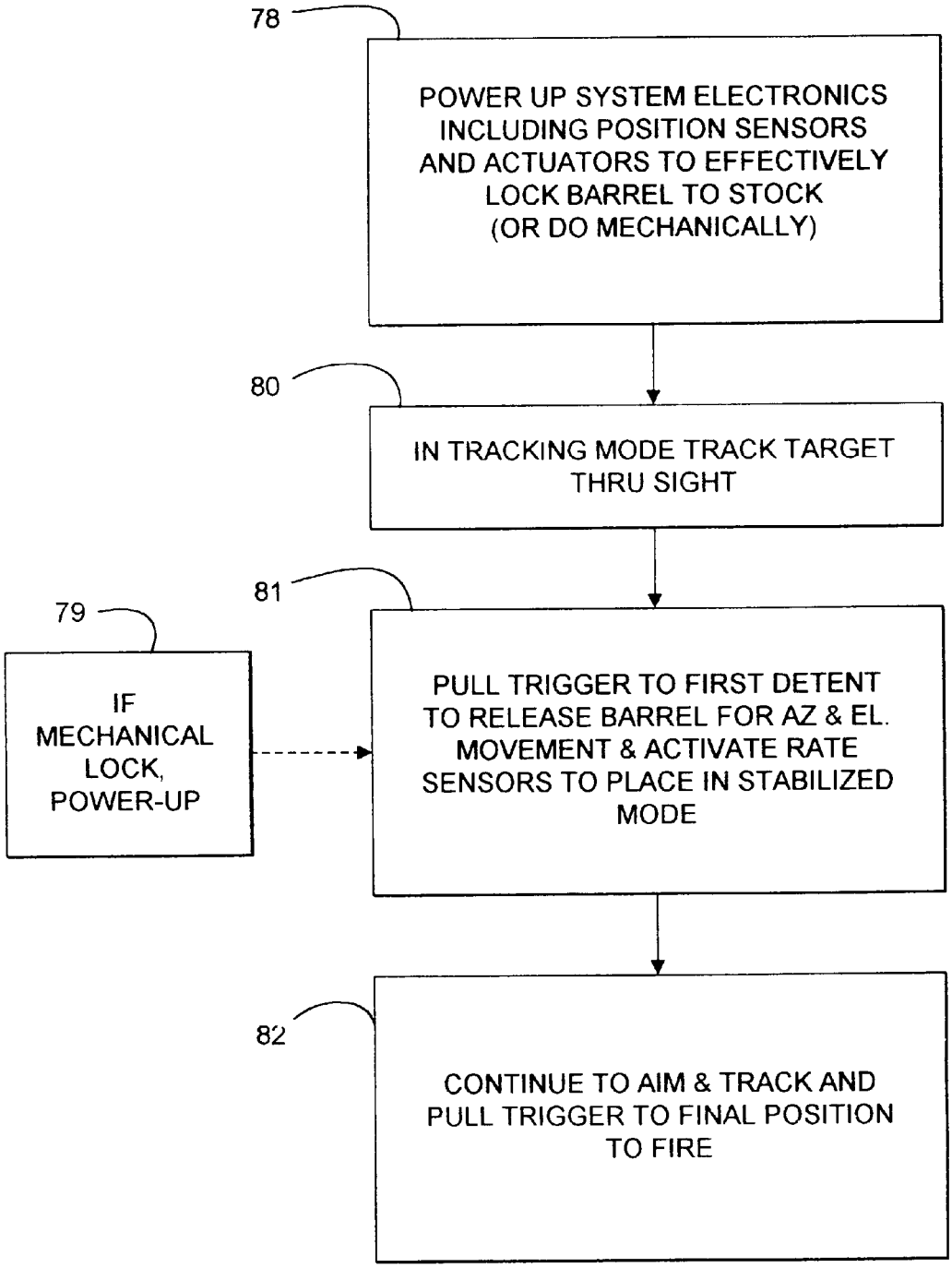
FIG. 13 is a flow sheet illustrating the method of the invention.

The overall operation of the present invention is summarized in FIG. 13. Here the flow chart step 78 states that the system electronics are powered up including position sensors and actuators to effectively lock the barrel to the stock. And the powering up is done, of course, by activating the on-off switch 24. This could alternatively be done by another detent location on the rifle trigger. And alternatively, rather than powering up the electronics at this point, as indicated by an alternative step 79, no power up is necessary until it is desired to activate the rate sensors 21*a*, 21*b*. However in the preferred embodiment, power up occurs to activate the position sensors and actuators to effectively lock the barrel to the stock. And then in step 80 the user of the rifle or gun tracks the target through the sight. In step 81 when the target is sighted the trigger is pulled to the first detent to release the barrel for azimuth and elevation movement. Thus the effective lock is released between the barrel and the stock. The rate sensors are also activated to place the system in a stabilized mode where the output signals from the rate sensors drive the actuators to make the barrel relatively immune to movement of the stock. Finally in step 82 when the rifle continues to be aimed, the trigger is pulled to the final position to fire the rifle.

Thus in summary the present invention provides a unique battery operated stabilization system, especially for direct fire weapons such as sniper rifles, and small arms fired from moving platforms such as helicopters and fast attack vehicles. The use of micro machined inertial rate sensors, position sensors, and actuators together with a fuzzy inference engine results in a highly effective low cost control system that has applications in many other fields.

What is claimed is:

1. A fire control system for firing a gun or rifle at a target from a moving platform carrying a human being who is visually tracking in a tracking mode said target by aiming said gun or rifle at said target and actuating the trigger to fire said gun or rifle, or where such human being has erratic hand or body motion, said system comprising:

a said gun or rifle having a sight, a stock movable by said human being, and a barrel freely mounted on said stock at a loading end with its exit end movable in both azimuth and elevation directions, in each direction over a predetermined angle, by actuator means connected between said stock and said barrel for moving said barrel over said predetermined angles, said barrel having a monostable position substantially aligned with said stock;

servomechanism means including a fuzzy logic controller for controlling said actuator means, both during said tracking mode and a stabilizing mode, said actuator means in said tracking mode causing said barrel to be aligned with said stock despite movement of said stock by said human being who is tracking said target by use of said sight and in said stabilizing mode, after said target has been tracked and when said trigger is about to be actuated to fire said rifle, said actuator means moving said barrel with reference to said stock to facilitate remaining sighted on said tracked target irrespective of movement of said stock.

2. A fire control system as in claim 1 where said servomechanism means for said tracking mode includes position sensor means coupled between said barrel and said stock which produce output signals related to movement of said barrel in said azimuth and elevation directions relative to said stock, said servomechanism means for said stabilizing mode including motion sensor means coupled to said barrel, actuated only just prior to full actuation of the trigger to fire said gun or rifle, which produce output signals proportional to the angular rate of displacement of said barrel in said azimuth and elevation directions to drive said actuator means to move said barrel with reference to said stock, to make said barrel relatively immune to movement of said stock to facilitate remaining sighted on said target.

3. A fire control system as in claim 2 where said fuzzy logic controller is responsive to said output signals of said rate and position sensor means for driving said actuator means.

4. A fire control system as in claim 3 where said rate and position sensor means provide an additional signal which is a rate of change signal derived by measuring the said output signal in equal time intervals and computing the difference between two sequential readings.

5. A fire control system as in claim 4 where each of said sensor output signals is at least related to displacement in azimuth of said barrel from said stock including far left, left, zero, right and far right, and said rate of change signal is either negative, zero or positive.

6. A fire control system as in claim 5 where said actuator means includes positive and negative displacements of normal, large, small or zero and the following fuzzy logic rules are applicable:

| Rule | | Output Signal | Rate of Change | | Actuator |
|---|---|---|---|---|---|
| 1 | If | FL | | Then | L(+) |
| 2 | If | L | (−) | Then | (+) |
| 3 | If | L | (+) | Then | S(+) |
| 4 | If | 0 | | Then | 0 |
| 5 | If | R | (−) | Then | S(−) |
| 6 | If | R | (+) | Then | (−) |
| 7 | If | FR | | Then | L(−) |
| | | L = Left<br>R = Right<br>F = Far | | | L = Large<br>S = Small. |

7. A fire control system for firing a gun or rifle at a target from a moving platform carrying a human being who is visually tracking in a tracking mode said target by aiming said gun or rifle at said target and actuating the trigger to fire said gun or rifle, or where such human being has erratic hand or body motion, said system comprising:

a said gun or rifle having a sight, a stock movable by said human being, and a barrel freely mounted on said stock at a loading end with its exit end movable in both azimuth and elevation directions, in each direction over a predetermined angle, by actuator means connected between said stock and said barrel for moving said barrel over said predetermined angles, said barrel having a monostable position substantially aligned with said stock;

means for retaining said barrel in alignment with said stock despite movement of said stock by said human being while in said tracking mode;

servomechanism means including a fuzzy logic controller for controlling said actuator means at least during a stabilizing mode after said target has been tracked and when said trigger is about to be actuated to fire said rifle for moving said barrel with reference to said stock to facilitate remaining sighted on said tracked target irrespective of movement of said stock.

8. A fire control system as in claim 7 where said servomechanism means for said stabilizing mode includes motion sensor means coupled to said barrel which produce output signals proportional to the angular rate of displacement of said barrel in said azimuth and elevation directions to drive said actuator means to move said barrel with reference to said stock, to make said barrel relatively immune to movement of said stock, to facilitate remaining sighted on said target.

9. A fire control system as in claim 8 where said motion sensor means is microminiature and solid-state having a pair of tuning forks for sensing said motion by angular rate.

10. A fire control system as in claim 7 including trigger switching means attached to said stock for placing said servomechanism means in said stabilizing mode in response to movemenmt of said trigger from a rest position to a first detent position intermediate said rest and a firing position.

11. A fire control system as in claim 10 where said rifle or gun has sear means for firing and where said trigger switching means includes a first set of electrical contacts closed by movement of said trigger to said first detent position and a second set of contacts closed in said firing position for electrically activating said sear means.

12. A fire control system as in claim 11 including solenoid means carried by said barrel for actuating said sear means and including resettable one shot capacitor means connected to said solenoid means and activating said solenoid means upon closure of said second set of contacts.

13. A fire control system as in claim 11 where said trigger switching means includes means coupling said first and second set of contacts to actuate said second set of contacts upon further movement of both said first set of contacts past said first detent position of said trigger.

14. A fire control system for firing a gun or rifle at a target from a moving platform carrying a human being who is visually tracking in a tracking mode said target by aiming said gun or rifle at said target and actuating the trigger to fire said gun or rifle, or where such human being has erratic hand or body motion, said system comprising:

a said gun or rifle having a sight, a stock movable by said human being, and a barrel freely pivoted on said stock at a loading end with its exit end movable in both azimuth and elevation directions, in each direction over a predetermined angle, by horizontal and vertical actuator means connected between said stock and said barrel for moving said barrel over said predetermined angles in said azimuth and elevation directions, said barrel having a monostable position substantially aligned with said stock;

means for controlling said actuator means, including a fuzzy logic controller, during at least a stabilized mode where after said target has been tracked in said tracking mode and when said trigger is about to be actuated to fire said rifle for moving said barrel with respect to said stock to facilitate remaining sighted on said tracked target irrespective of movement of said stock.

15. A fire control method for firing a gun or rifle at a target from a moving platform carrying a human being who is visually tracking in a tracking mode said target by aiming said gun or rifle at said target and actuating the trigger to fire said gun or rifle, or where such human being has erratic hand or body motion, said gun or rifle having a sight, a stock movable by said human being, and a barrel freely mounted on said stock at a loading end with its exit end movable in both azimuth and elevation directions, each over a predetermined angle by actuator means connected between said stock and said barrel for moving said barrel over said predetermined angles, said method comprising the following steps:

effectively locking said barrel to said stock;

in said tracking mode visually tracking said target through said sight;

pulling said trigger to a first detent to release said effective lock between said barrel and stock and activating a pair of rate sensors on said barrel respectively responsive to movement in said azimuth and elevation directions to produce output signals related to such movement of said barrel;

and using said output signals to drive said actuator means to stabilize said barrel, to make such barrel relatively immune to movement of said stock, and continuing to aim and track and pulling said trigger to a final position to fire said rifle.

* * * * *